US009570833B2

(12) United States Patent
Kloosterboer

(10) Patent No.: US 9,570,833 B2
(45) Date of Patent: Feb. 14, 2017

(54) SYSTEMS, APPARATUSES AND METHODS FOR REDUCING ACCESS TO MEDICAL DEVICE ELECTRICAL CONNECTIONS

(71) Applicant: St. Jude Medical, Atrial Fibrillation Division, Inc., St. Paul, MN (US)

(72) Inventor: Michael J. Kloosterboer, Minneapolis, MN (US)

(73) Assignee: St. Jude Medical, Atrial Fibrillation Division, Inc., St. Paul, MN (US)

( * ) Notice: Subject to any disclaimer, the term of this patent is extended or adjusted under 35 U.S.C. 154(b) by 0 days.

(21) Appl. No.: 14/786,478

(22) PCT Filed: Apr. 30, 2014

(86) PCT No.: PCT/US2014/036172

§ 371 (c)(1),
(2) Date: Oct. 22, 2015

(87) PCT Pub. No.: WO2014/179463

PCT Pub. Date: Nov. 6, 2014

(65) Prior Publication Data

US 2016/0111806 A1 Apr. 21, 2016

Related U.S. Application Data

(60) Provisional application No. 61/818,173, filed on May 1, 2013.

(51) Int. Cl.
*H01R 12/00* (2006.01)
*H01R 13/447* (2006.01)

(52) U.S. Cl.
CPC ..... *H01R 13/447* (2013.01); *H01R 2201/12* (2013.01)

(58) Field of Classification Search
CPC ..... H01R 9/096; H01R 23/722; H01R 9/0735; H01R 23/682; H01R 9/0742; H01R 23/668
USPC ..... 439/65, 66, 67, 326, 493–496, 498, 499
See application file for complete search history.

(56) References Cited

U.S. PATENT DOCUMENTS 7,855,898 B2 * 12/2010 Tang ..... G06F 1/186 312/223.2
8,096,626 B2 * 1/2012 Tang ..... G06F 1/181 312/223.2
8,382,215 B2 * 2/2013 Chen ..... G06F 1/186 312/223.2
8,920,189 B1 * 12/2014 Andre ..... F16C 11/04 439/501

(Continued)

FOREIGN PATENT DOCUMENTS

EP 2204887 7/2010
JP 2010218880 9/2010

OTHER PUBLICATIONS

International Search Report for PCT Application No. PCT/US2014/036172 dated Jul. 24, 2014. 5 pgs.

*Primary Examiner* — Phuongchi T Nguyen
(74) *Attorney, Agent, or Firm* — Armstrong Teasdale LLP

(57) ABSTRACT

Systems, apparatuses and methods to enhance the safety of medical devices by reducing unwanted access to electrical connections on such medical devices are provided. A medical electrical connection safety mechanism includes at least a cover or other barrier (106) and a barrier securing mechanism to assist with closing the cover (106) when not in use.

8 Claims, 10 Drawing Sheets

(56) References Cited

U.S. PATENT DOCUMENTS

2011/0089012 A1* 4/2011 Tang ..... H01H 3/20
200/522
2012/0295457 A1 11/2012 Holland

* cited by examiner

SYSTEMS, APPARATUSES AND METHODS FOR REDUCING ACCESS TO MEDICAL DEVICE ELECTRICAL CONNECTIONS

FIELD OF DISCLOSURE

The present disclosure relates generally to medical devices including one or more electrical connections, and to systems, apparatuses and methods to enhance safety by reducing inadvertent, accidental, unintended or otherwise undesired access to the electrical connections.

BACKGROUND

External electrical connections are often present on medical devices to serve various functions. These electrical connections can link the medical device to another medical device, to the patient, to the operator, to a power supply, etc. Each of the various types of connections may have different standards associated with their connection to ensure the safety of both the patient and the operator. Such standards can ensure varying levels of creepage distances and air clearances or specified voltage isolation.

Defibrillation-proof applied parts are a class of parts that require protection against the effects of a cardiac defibrillator to the patient. Standards may suggest or mandate design or use requirements. One exemplary standard surrounding a defibrillation-proof part is IEC 60601-1:2005/(R)2012, of which Section 8.5.5.1 thereof titled "Defibrillation Protection" now includes any unused or disconnected connections of the applied part. As a result, an increased number of medical electrical connections are now required to be defibrillation-proof.

Based on the foregoing, it would be advantageous to provide improved methods, systems, and apparatuses for enhancing safety by reducing inadvertent, accidental, unintended or otherwise undesired access to electrical connections.

BRIEF SUMMARY

In one aspect, the present disclosure is directed to a safety mechanism for an electrical connection. The safety mechanism comprises a door, and a barrier securing mechanism configured to hold the door in a closed position when the electrical connection is not in use.

Another aspect of the present disclosure is directed to an electrical connection for a medical device. The electrical connection comprises a receptacle including one or more conductors configured to transmit energy to or from the medical device, and configured to receive a connecting cable for delivering the energy to or from the medical device. The electrical connection further comprises a barrier that is configured to substantially cover the receptacle when the connecting cable is not connected to the electrical connection, a barrier mount coupled to the receptacle and configured to engage the barrier when the connecting cable is not connected to the electrical connection, and a barrier securing mechanism configured to releasably hold the barrier in place over the receptacle when the connecting cable is not connected to the electrical connection, and to release the holding of the barrier to facilitate access of the receptacle by the connecting cable.

Another aspect of the present disclosure is directed to an electrical connection for a medical device. The electrical connection comprises a receptacle including one or more conductors configured to transmit energy to or from the medical device, and configured to receive a connecting cable for delivering the energy to or from the medical device. The electrical connection further comprises a barrier configured to substantially cover the receptacle when the connecting cable is not connected to the electrical connection, a barrier mount coupled to the receptacle and configured to engage the barrier when the connecting cable is not connected to the electrical connection, and a first barrier securing mechanism coupled to the barrier to assist the barrier in covering the receptacle upon disconnection of the connecting cable.

The foregoing and other aspects, features, details, utilities, and advantages of the present disclosure will be apparent from the following description and claims, and from the accompanying drawings.

DETAILED DESCRIPTION

Figure 1:
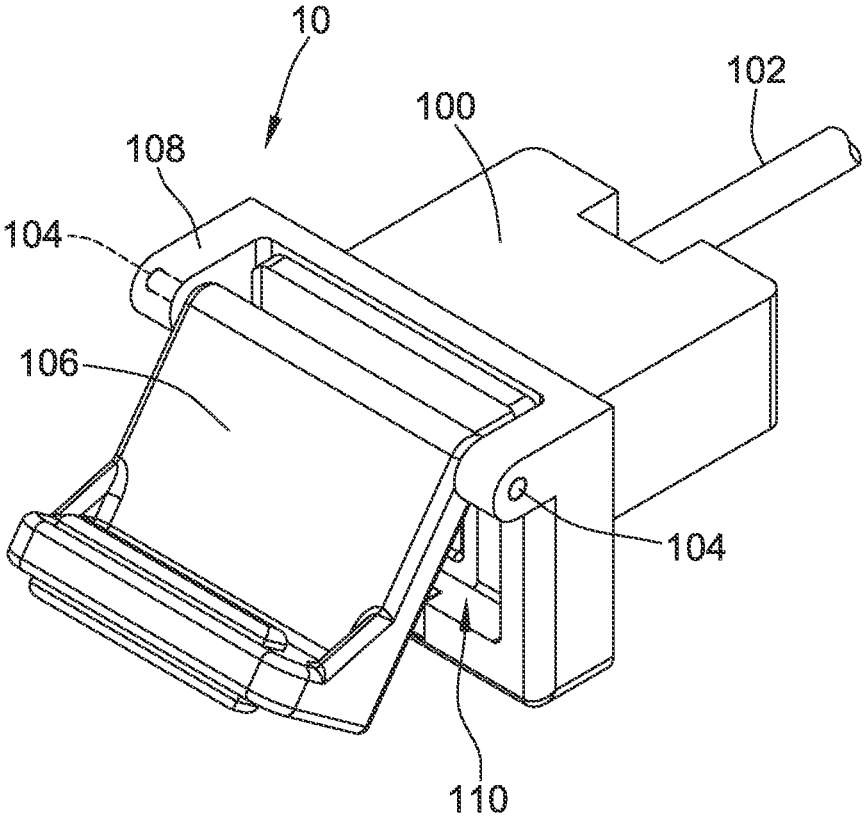
FIG. 1 is an exemplary apparatus configured to enhance the safety of a medical device.

The present disclosure describes systems, apparatuses and methods for enhancing safety when using electrical connections, such as on medical devices. Among other things, the disclosure sets forth systems, apparatuses, and methods for covering electrical connections, and in some embodiments automatically covering such electrical connections, when a mating electrical connector is not inserted into the electrical connection or is removed from the electrical connection.

Such systems, apparatuses, and methods increase electrical isolation between the electrical connection and a patient, physician, and/or other user when the electrical connection is not actively being used. In some embodiments, a cover, door or other structure or barrier is used to add a mechanical barrier in addition to an increased electrical barrier between the electrical connection and the environment. Specifically, in some embodiments, a cover, door or other structure or barrier may be used to cover a receptacle (e.g., a female connector receptacle with one or more electrical conductors; a protruding member such as a male connector protrusion with one or more electrical conductors; a substantially flat or "in-line" member such as a connector substantially in-line with the structure housing; or other electrical connections), and may be configured to form a barrier between the electrical connection and a user, patient, etc. when not in use.

The cover, door or other structure or barrier (hereinafter referred to as the "door") may be flat, contoured, or otherwise sized and configured to suitably cover an electrical connection. For example, in one exemplary embodiment, a flat or other shaped door is configured to provide a suitable barrier over a female connector receptacle in which power/energy conductors reside. In another exemplary embodiment, a flat or other shaped door is configured to provide a suitable barrier over a structure that is "in-line" or largely planar with its surrounding structure (e.g., a generator body) having individual receptacles for one or more conductors. In yet another exemplary embodiment, a shaped door, such as a contoured cap, is configured to provide a suitable cover or barrier over a protruding member (i.e., a male connector end). These and other exemplary embodiments provide the enhanced safety for medical devices as described herein.

More particularly, the above-described doors may be configured to cover or otherwise provide a barrier to an electrical connection when the door is in the closed position, while allowing access to the electrical connection when the door is in the open position. Such a door may be equipped with, for example, a barrier securing mechanism configured to hold or bias the door against or in close proximity to a housing of the electrical connection when an electrical connector is not engaged with the electrical connection.

In one embodiment, the barrier securing mechanism may include a magnet or a ferromagnetic material positioned on or in the door and configured to engage a separate magnet or ferromagnetic material positioned on or in a door mount coupled to the electrical connection such that when the door is in a closed position, the magnetic force holds the door in close proximity to the door mount. In this exemplary embodiment, the magnet or ferromagnetic material can be affixed to the door or door mount with either plastic injection over molding techniques or with a structural adhesive, such as, for example, cyanoacrylate or acrylic. Plastic injection over molding allows both components to be affixed in place during the molding process, both improving reliability and manufacturability. Additionally, the use of a magnet and a single ferromagnetic component (as opposed to the use of two magnets) allows the polarity of the magnet to be ignored during assembly, which could improve the manufacturability of the design.

In another embodiment, the barrier securing mechanism may include a spring system configured to bias the door against or in close proximity to the door mount coupled to the electrical connection when an electrical connector is not engaged with the electrical connection. Among others, one benefit of such an embodiment is that it can be designed so it is not dependent upon gravity to assist in automatically closing the door. That is, a door including a spring system can allow additional functional orientations (i.e., other than lying in a vertical plane) of the electrical connection while providing an appropriate level of defibrillation protection, including both electrical and mechanical protection, when the electrical connection is not in use. In another embodiment, the barrier securing mechanism may include a combination of both a magnet and/or ferromagnetic material as well as a spring system.

With reference now to the figures, FIG. 1 is a perspective view of an apparatus 10 configured to enhance the safety of a medical device. Particularly, an electrical connection 100 may be used in combination with an electrical connector to supply energy from a generator (not shown) to a device, such as a medical device. Electrical connection 100 may be attached to a generator (not shown) via cable(s) 102. In one embodiment, electrical connection 100 is a connector assembly for a neutral electrode, return electrode, or dispersive electrode that may be used in connection with ablation or other necrosis or tissue altering procedures (e.g., renal denervation, endocardial and epicardial ablation, etc.).

Figure 2:
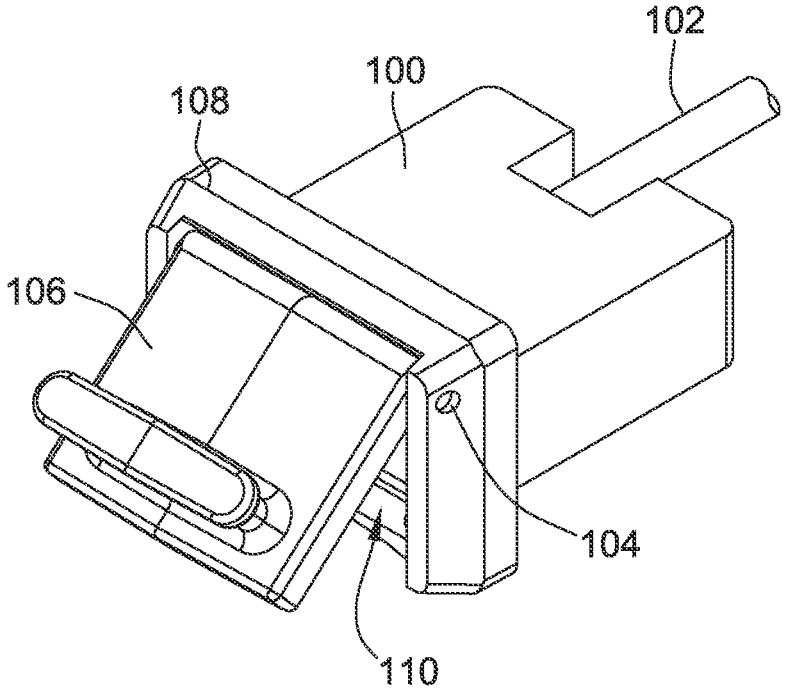
FIG. 2 is an alternative apparatus configured to enhance the safety of a medical device.

A door 106 may be secured to a door mount 108 via at least door shafts 104, thereby enabling door 106 to pivotally cover or uncover receptacle 110 or other opening defined at least in part by door mount 108. In particular, in the embodiment illustrated in FIGS. 1, 2, and 13, one or more door shafts 104 provide a pivoting mechanism by which door 106 can be moved. Door mount 108 may be formed separate from electrical connection 100 (FIG. 1) or may be formed integrally with electrical connection 100 (FIG. 2). Further, door 106 and door mount 108 may be formed of any suitable material, including but not limited to acrylonitrile butadiene styrene.

Receptacle 110 may include one or more conductors to transmit energy to or from a medical device, where energy may be sourced or return current, voltage, whether direct current, or alternating current involving complex impedance. As used herein, transmission of energy also includes neutral electrode couplings, return electrode couplings, dispersive electrode couplings, ground connections, etc., as well as directly sourcing or sinking energy. Receptacle 110 may be configured to receive a connecting cable (not shown) delivering the energy, where "delivering" is used herein to either source or sink energy. Door 106 is configured to substantially cover receptacle 110 when the connecting cable (not shown) is not connected to electrical connection 100.

In some embodiments, door 106 and door mount 108 may include a barrier securing mechanism configured to hold or bias door 106 in place (e.g., against, in close proximity to, or sufficiently near door mount 108) and over receptacle 110 when a connecting cable (not shown) is not connected to electrical connection 100 (i.e., when electrical connection 100 is not in use). The barrier securing mechanism is further configured to allow door 106 to be released to facilitate access of receptacle 110 by the connecting cable.

Figure 3:
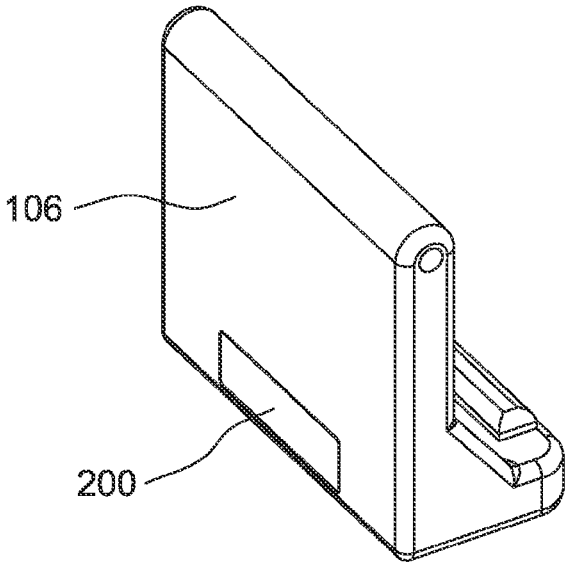
FIGS. 3 and 4 are perspective views of an exemplary door, cover or other barrier for use in the apparatus of FIG. 1.
Figure 4:
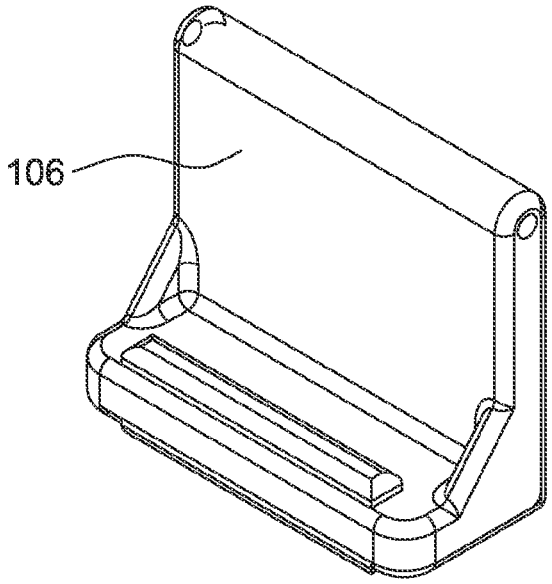
Figure 5:
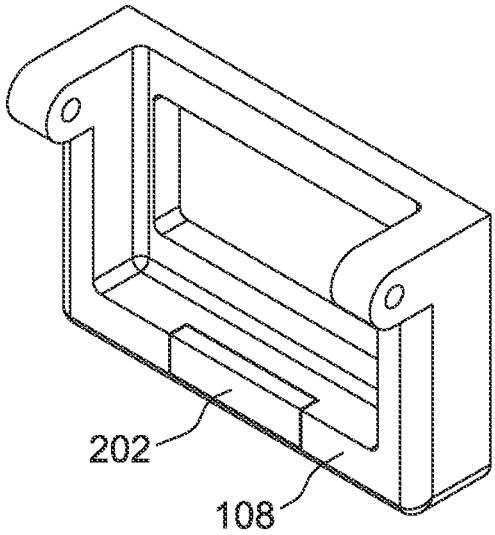
FIG. 5 is a perspective view of an exemplary door mount for use in the apparatus of FIG. 1.
Figure 6:
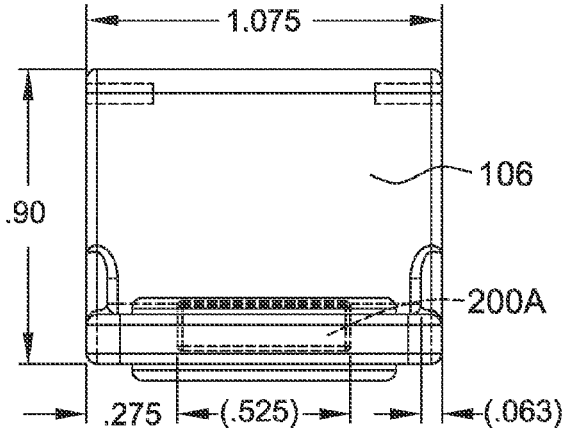
FIGS. 6-8 illustrate dimensions of a door for use in the apparatus of FIG. 1 in one particular embodiment.
Figure 7:
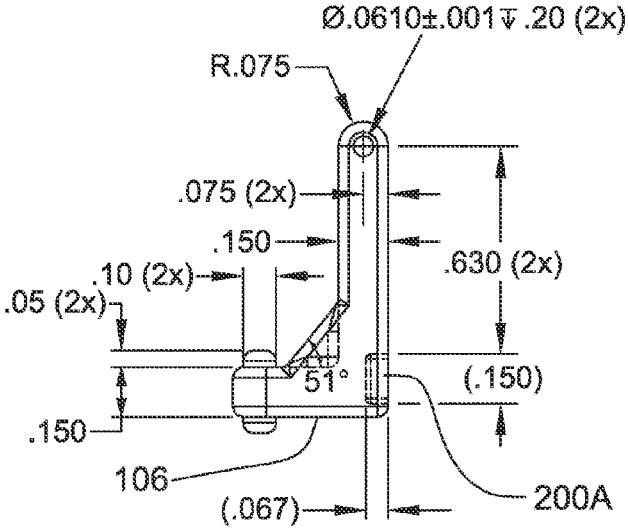
Figure 8:
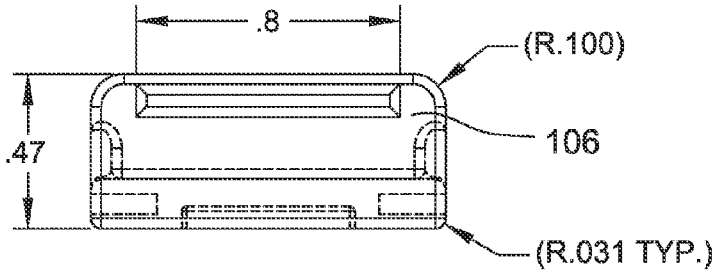
Figure 9:
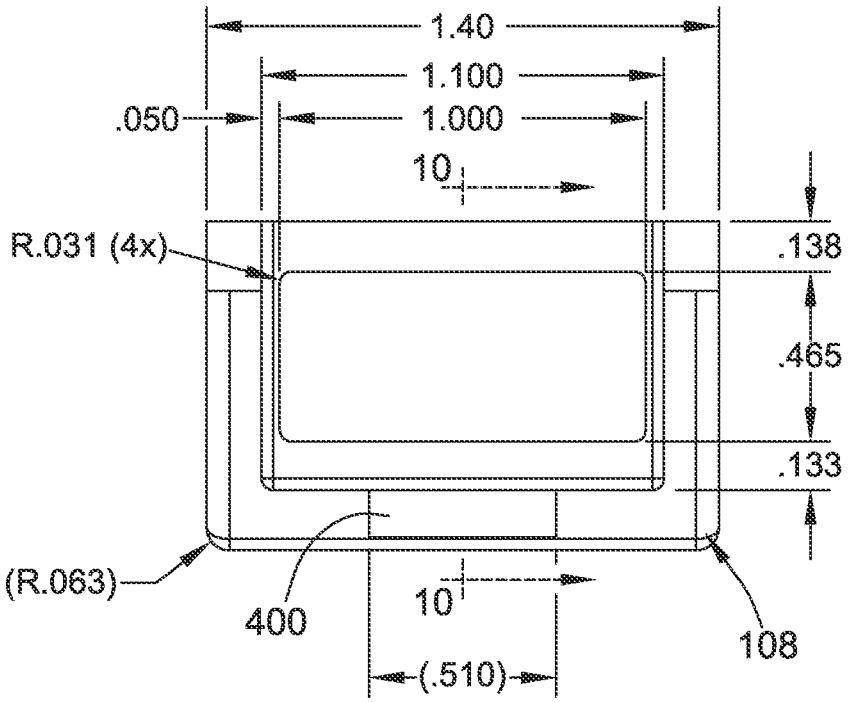
FIGS. 9-12 illustrate dimensions of a door mount for use in the apparatus of FIG. 1 in one particular embodiment.
Figure 10:
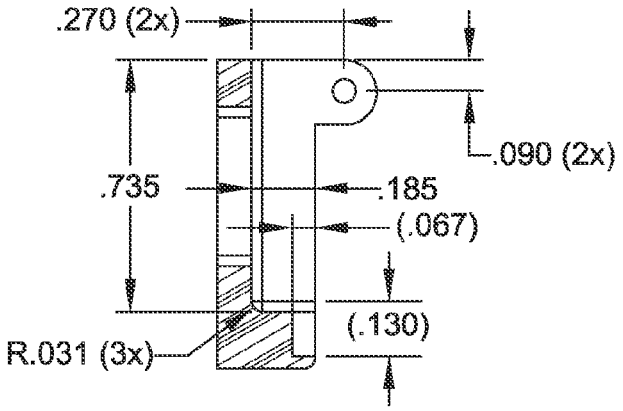
Figure 11:
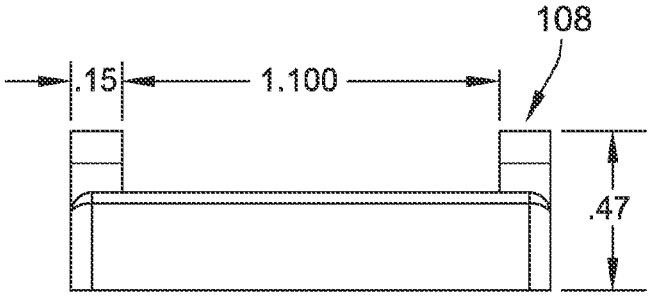
Figure 12:
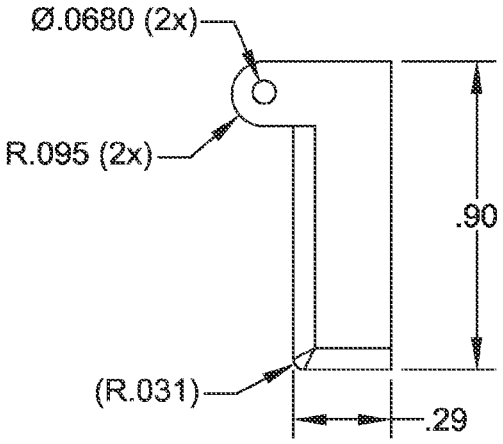

In one embodiment, as shown in FIGS. 3-5, the barrier securing mechanism may include a first securing portion 200 coupled to door 106 (FIG. 3) and a second securing portion 202 coupled to door mount 108 (FIG. 5). First and second securing portions 200 and 202 may comprise a magnet or a ferromagnetic material resulting in various mating combinations including, but not limited to, magnet-magnet; magnet-ferromagnetic material; or ferromagnetic material-magnet. One skilled in the art will appreciate that any magnetic embodiments described herein may be employed with permanent magnets, and/or temporary magnets, and/or electromagnets, etc. For example, in one particular embodiment, first securing portion 200 is a magnet, such as a Neodymium (NdFeB) magnet grade 42, ½ inch×⅛ inch×1/16 inch, and second securing portion 202 is a ferromagnetic material such as nickel plated steel, ½ inch×⅛ inch×1/16 inch. The use of a magnet in combination with a ferromagnetic material allows the polarity of the magnet to be ignored during assembly, thus improving the manufacturability of the design.

First and second securing portions 200 and 202 may be coupled to door 106 and door mount 108 in any manner suitable to sufficiently affix first and second securing portions 200 and 202 to door 106 and door mount 108, respectively. For example, in one embodiment, first securing portion 200 may be coupled to door 106 and second securing portion 202 may be coupled to door mount 108 via a plastic bonder (such as, but not limited to, cyanoacrylate or acrylic)

such that first and second securing portions 200 and 202 are positioned flush with, slightly below, or slightly above door 106 or door mount 108, respectively. In another embodiment, first and second securing portions 200 and 202 are in-molded (e.g., with plastic injection over-molding techniques) within door 106 or door mount 108, respectively, during manufacture of door 106 and door mount 108.

First securing portion 200 and second securing portion 202 may be of any suitable size and shape such that a sufficient attractive force is created between first and second securing portions 200 and 202 to facilitate the holding of door 106 in place relative to door mount 108. In one embodiment, first and/or second securing portions 200, 202 extend over only a portion of the length of door 106 or door mount 108, respectively. In another embodiment, first and/or second securing portions 200, 202 extend across substantially the entire length of door 106 or door mount 108, respectively.

FIGS. 6-12 illustrate dimensions of one specific embodiment of door 106 and door mount 108 including first securing portion 200 and second securing portion 202 and for use in combination with a particular electrical connection 100. One skilled in the art will appreciate that door 106 and door mount 108 may have any shape, configuration, or size so as to operate in the manner described herein.

Figure 13:
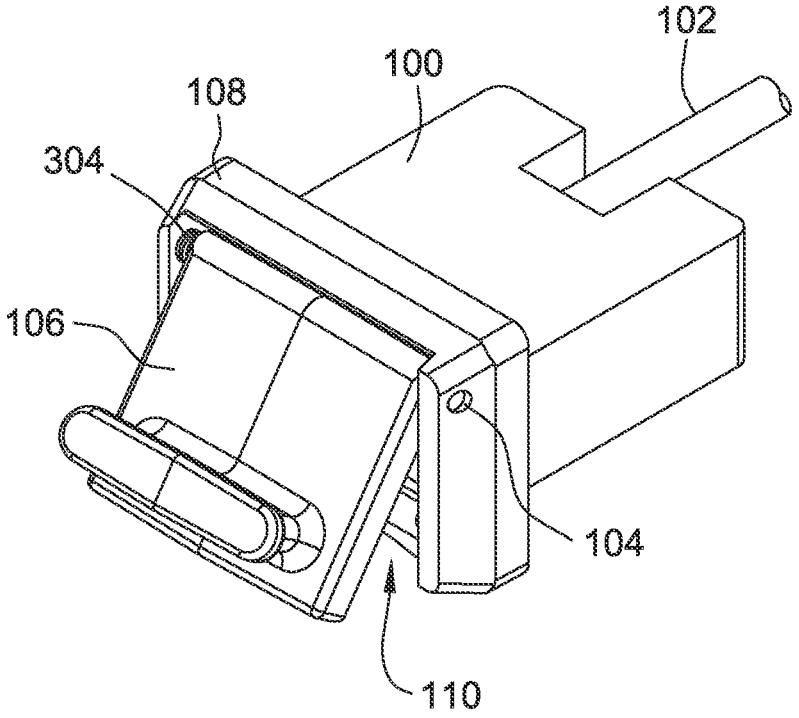
FIG. 13 is a perspective view of an exemplary apparatus including a spring system.
Figure 14:
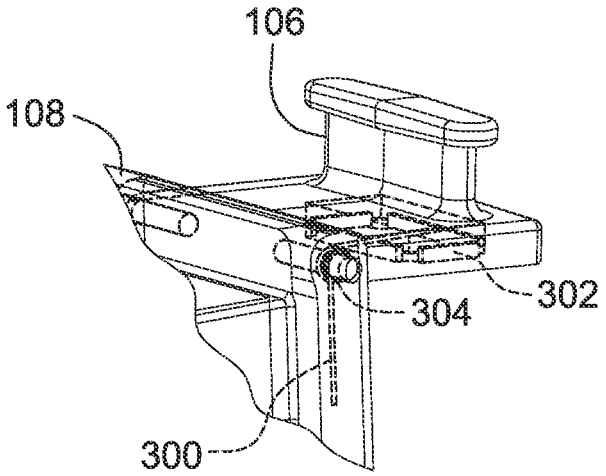
FIG. 14 a partial view of the apparatus of FIG. 13 showing internal construction.

In another embodiment, the barrier securing mechanism configured to hold or bias door 106 against, in close proximity to, or sufficiently near door mount 108 includes a spring system, such as a torsion spring, as illustrated in FIGS. 13 and 14. In this embodiment, a first anchor point 300 is positioned within door mount 108, and a second anchor point 302 is positioned within door 106 (FIG. 14). First and second anchor points 300 and 302 meet at coil 304. Coil 304 acts as a torsion member and is configured to store mechanical energy upon twisting when door 106 is lifted or moved away from door mount 108 and to release the mechanical energy through door 106 when electrical connection 100 is not in use such that door 106 is biased in a position adjacent to or near door mount 108.

In one embodiment, the barrier securing mechanism includes either the magnet and the ferromagnetic material or the spring system described above. In another embodiment, the barrier securing mechanism includes each of the magnet and ferromagnetic material and the spring system described above. In either embodiment, the barrier securing mechanism ensures that door 106 is configured to remain closed or biased against or near door housing 108 or electrical connection 100 even if electrical connection 100, door mount 108, and door 106 are positioned in such a way (e.g., at an angle) where gravity alone is not sufficient to hold or bias door 106 in a position against or near door mount 108 or electrical connection 100.

Figure 15:
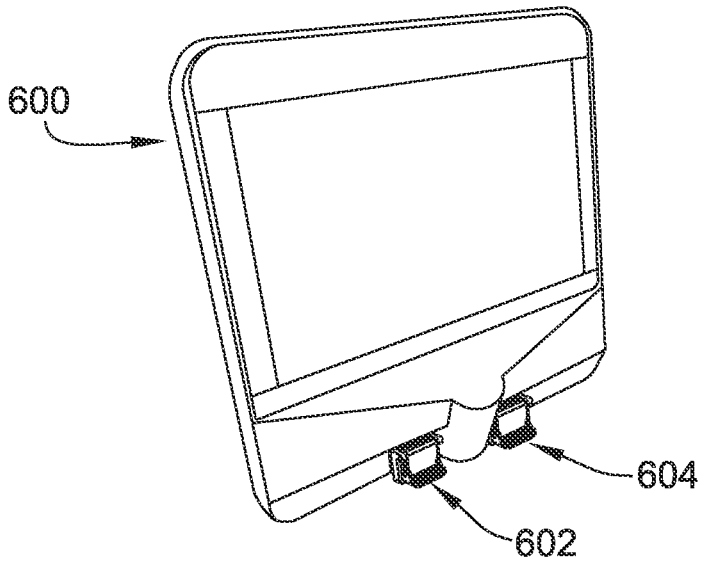
FIG. 15 is a perspective view of an exemplary generator device on which the door of FIGS. 3 and 4 may be utilized.
Figure 16:
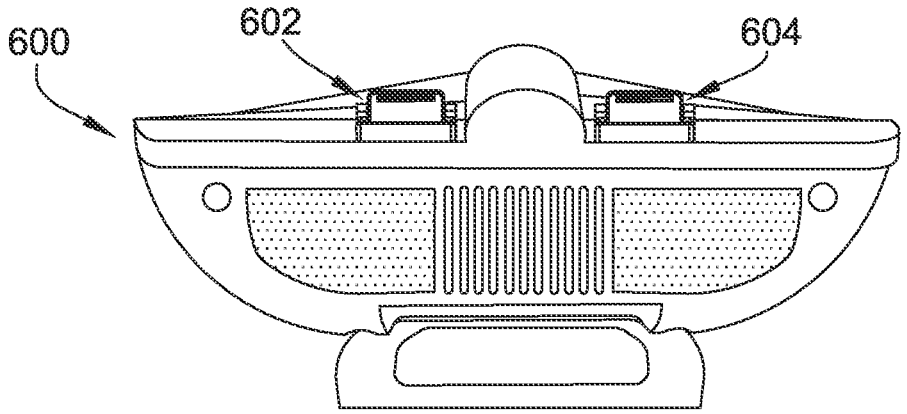
FIG. 16 is a bottom view of the generator device of FIG. 15.

FIGS. 15 and 16 depict front and bottom views, respectively, of an exemplary generator device on which electrical connections 100 and accompanying doors 106 including a barrier securing mechanism may be utilized. The generators may be medical device generators, such as used in connection with renal denervation, atrial fibrillation ablation, ventricular ablation, or other medical procedures. It should be noted that the disclosure provided herein is usable in any medical or other device where safety is enhanced by limiting access to electrical connectors when a cable or other mating part is not engaged with the electrical connection.

In the embodiment illustrated in FIGS. 15 and 16, generator 600 includes a first electrical connection 602 and a second electrical connection 604. Each of the first and second electrical connections 602, 604 correspond to, for example, electrical connection 100 of FIG. 1 or FIG. 2. In one embodiment, one of electrical connections 602 or 604 may be used while the other electrical connection is not in use such that a patient is connected to the generator and the generator comprises an electrical connection that is not currently in use. Without a barrier (e.g., door 106) covering the unused electrical connection 602 or 604, an operator or other bystander could come into contact with the unused electrical connection freely, which would preset an unsafe electrical situation between the operator or bystander and the patient. The barrier or door provides defibrillation protection from the patient.

Figure 17:
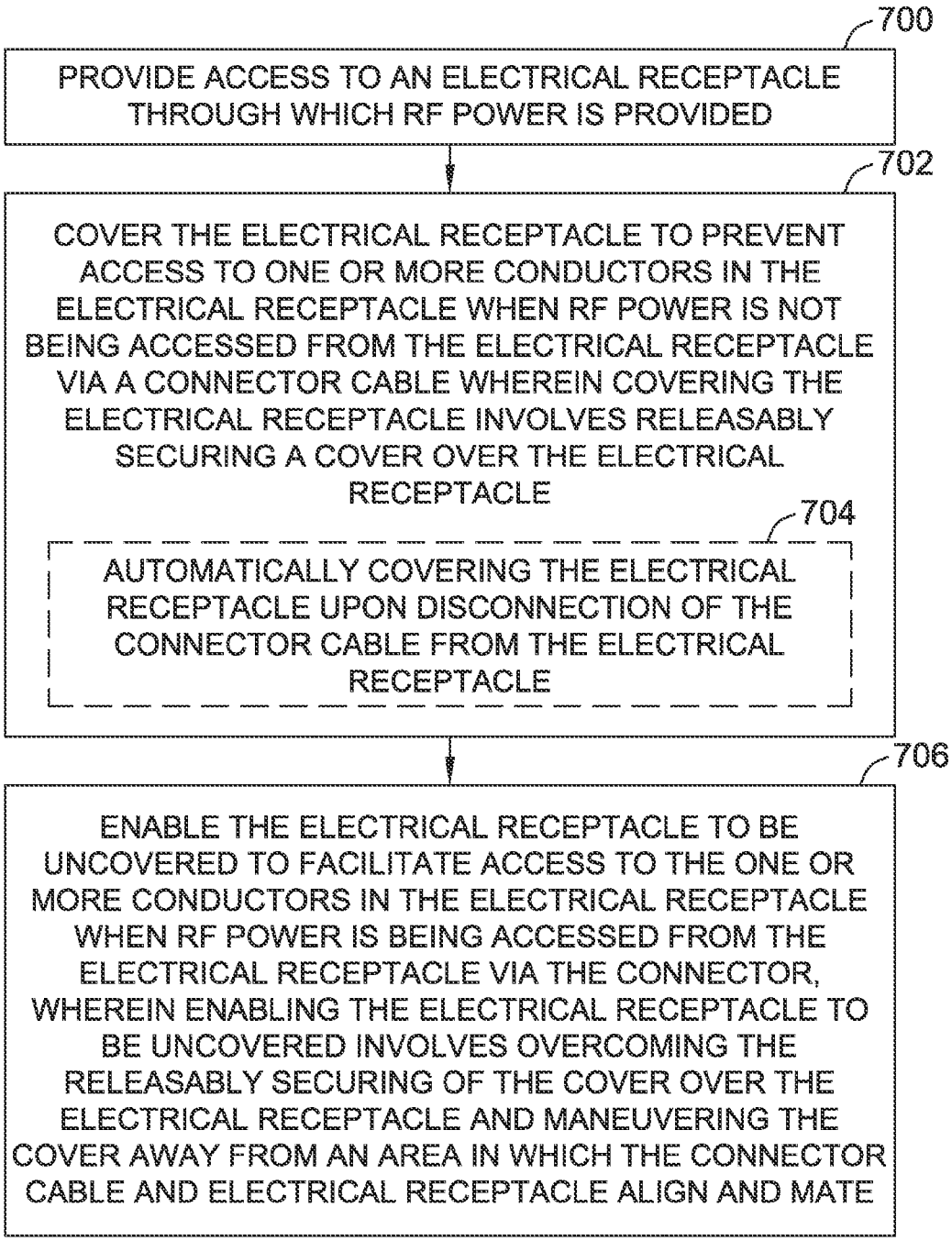
FIG. 17 is a flow diagram for limiting access to electrical connections in medical devices.

FIG. 17 is a flow diagram for limiting access to an electrical connection in medical devices. Access is provided 700 to an electrical receptacle through which power (e.g., RF power) is provided. The electrical receptacle is covered 702 to prevent access to one or more conductors in the electrical receptacle when power is not being accessed from the electrical receptacle via a connector cable, wherein covering the electrical receptacle comprises releasably securing a cover over the electrical receptacle. In one particular embodiment, covering 702 the electrical receptacle involves automatically covering 704 the electrical receptacle upon disconnection of the connector cable from the electrical receptacle. The method may involve enabling 706 the electrical receptacle to be uncovered to facilitate access to the one or more conductors in the electrical receptacle when power is being accessed from the electrical receptacle via the connector, wherein enabling the electrical receptacle to be uncovered involves overcoming the releasably securing of the cover over the electrical receptacle and maneuvering the cover away from an area in which the connector cable and electrical receptacle align and mate.

Thus, the disclosure herein contemplates systems, apparatuses, and methods for enhancing safety by reducing inadvertent, accidental, unintended or otherwise undesired access to electrical connections through the use of a barrier securing mechanism. By including a barrier securing mechanism to ensure that a door that covers an electrical connection is held or biased either against or near a door mount or the electrical connection itself and by requiring a user to actively open the door to access the electrical connection, isolation of the user from the electrical connection can be achieved when the electrical connection is not in use.

Although a number of various embodiments are described herein with varying degrees of particularity, those skilled in the art could make numerous alterations to the disclosed embodiments without departing from the spirit or scope of the teachings provided herein. It should be noted that directional references (e.g., upper, lower, upward, downward, left, right, leftward, rightward, top, bottom, above, below, vertical, horizontal, clockwise, and counterclockwise) are only used for identification purposes to aid the reader's understanding of the described embodiments and disclosed subject matter, and do not create limitations, particularly as to the position, orientation, or use of the embodiments described herein. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the disclosure of which embodiments thereof may be set forth in appended claims.

What is claimed is:

1. A medical device connection comprising:

a receptacle including one or more conductors configured to transmit energy to or from the medical device, and configured to receive a connecting cable for delivering the energy to or from the medical device;

a barrier configured to substantially cover the receptacle when the connecting cable is not connected to the electrical connection;

a barrier mount coupled to the receptacle and configured to engage the barrier when the connecting cable is not connected to the electrical connection; and a barrier securing mechanism configured to releasably hold the barrier over the receptacle when the connecting cable is not connected to the electrical connection, and to release the holding of the barrier to facilitate access of the receptacle by the connecting cable, wherein the barrier securing mechanism comprises a first securing portion coupled to the barrier and a second securing portion coupled to the barrier mount, and wherein at least one of the first securing portion and the second securing portion is a ferromagnetic material.

2. The medical device connection of claim 1, wherein at least one of the first securing portion and the second securing portion is a magnet.

3. The medical device connection of claim 1, wherein the barrier comprises a door sized to cover at least a portion of a surface area of an opening of the receptacle.

4. The medical device connection of claim 1, wherein the first securing portion is a magnet and the second securing portion is a ferromagnetic material.

5. The medical device connection of claim 4, wherein the first securing portion and the second securing portion are aligned to magnetically and releasably hold the barrier over the receptacle when the connecting cable is not connected to the electrical connection, and to facilitate the release of the holding of the barrier to facilitate access of the receptacle by the connecting cable.

6. A medical device connection, comprising:

a receptacle including one or more conductors configured to transmit energy to or from the medical device, and configured to receive a connecting cable for delivering the energy to or from the medical device;

a barrier configured to substantially cover the receptacle when the connecting cable is not connected to the electrical connection;

a barrier mount coupled to the receptacle and configured to engage the barrier when the connecting cable is not connected to the electrical connection;

a first barrier securing mechanism coupled to the barrier to assist the barrier in covering the receptacle upon disconnection of the connecting cable; and a second barrier securing mechanism comprising a first securing portion coupled to the barrier and a second securing portion coupled to the barrier mount, wherein at least one of the first securing portion and the second securing portion is a magnet and at least one of the first securing portion and the second securing portion is a ferromagnetic material.

7. The medical device connection of claim 6, wherein the first barrier securing mechanism comprises at least one spring configured to releasably hold the barrier over the receptacle when the connecting cable is not connected to the electrical connection.

8. The medical device connection of claim 6, wherein the first securing portion and the second securing portion are aligned to releasably hold the barrier over the receptacle when the connecting cable is not connected to the electrical connection, and to facilitate the release of the holding of the barrier to facilitate access of the receptacle by the connecting cable.

* * * * *